United States Patent [19]

Hirata

[11] Patent Number: 4,572,418

[45] Date of Patent: Feb. 25, 1986

[54] PRINT PAPER FEEDING APPARATUS

[75] Inventor: Yoshikatsu Hirata, Nagoya, Japan

[73] Assignee: Brother Kogyo Kabushiki Kaisha, Nagoya, Japan

[21] Appl. No.: 616,129

[22] Filed: Jun. 1, 1984

[30] Foreign Application Priority Data

Jun. 17, 1983 [JP] Japan ..... 58-93688[U]

[51] Int. Cl.[4] ..... B65H 17/22; B65H 17/40; B41J 11/30

[52] U.S. Cl. ..... 226/74; 226/101; 226/188; 400/608.2

[58] Field of Search ..... 226/74, 75, 76, 101, 226/188; 400/596, 600.2, 600.3, 605, 608, 608.1, 608.2, 607.2, 608.3, 636.2

[56] References Cited

U.S. PATENT DOCUMENTS

| | | | |
|---|---|---|---|
| 1,213,189 | 1/1917 | Hart | 400/636.2 X |
| 2,130,015 | 9/1938 | Jensen | 400/636.2 X |
| 2,302,704 | 11/1942 | Mabon | 400/636.2 X |
| 3,567,096 | 3/1971 | McDermott | 226/188 |
| 3,761,000 | 9/1973 | Hagstrom | 226/188 X |
| 4,268,021 | 5/1981 | Rutishauser et al. | 400/636.2 X |
| 4,283,027 | 8/1981 | Naito | 226/188 X |
| 4,360,279 | 11/1982 | Sugiura | 400/600.2 X |
| 4,452,543 | 6/1984 | Adkisson et al. | 400/605 |

FOREIGN PATENT DOCUMENTS 205182 12/1982 Japan ..... 400/607.2

*Primary Examiner*—Harvey C. Hornsby
*Assistant Examiner*—Scott J. Haugland
*Attorney, Agent, or Firm*—Moonray Kojima

[57] ABSTRACT

A print paper feeding apparatus wherein a discrete print paper is fed by cooperative action of a platen and rollers, while a continuous print paper is fed by cooperative action of a platen and a pin tractor. The print paper feeding apparatus further comprises a gear transmitting mechanism disposed between a paper feed motor and the platen; an actuating lever pivotally supporting, at one end thereof, an idle gear engaged with a pin tractor driving gear, the actuating lever being movable between an engaged position wherein the idle gear engages a gear of the gear transmitting mechanism, and a disengaged position wherein such engagement is released; a switching lever connected at one end thereof to the other end of the actuating lever and supported switchably between the engaged and disengaged positions, the switching lever having an operating portion formed at the other end thereof; and a biasing member for urging and holding the actuating lever to and in the engaged disengaged positions.

6 Claims, 1 Drawing Figure

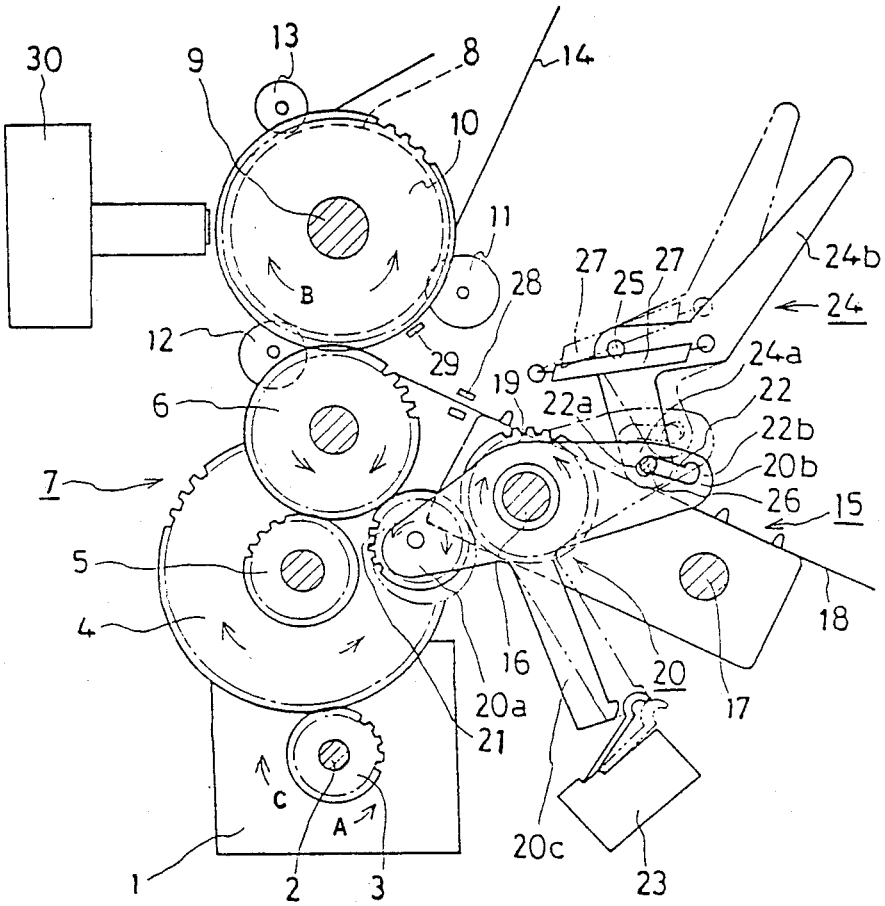
30
9
13
8
14
10
11
B
28
27
25
27
24b
24
12
29
19
24a
22a
22
22b
6
20b
7
26
15
5
4
18
16
20
20a
17
21
C
A
20c
1
2
3
23

PRINT PAPER FEEDING APPARATUS

BACKGROUND OF THE INVENTION

1. Field of Invention

This invention relates to a print paper feeding apparatus, such as used in printers, print machines, etc; and more particularly, to such an apparatus which is capable of switching the type of paper on a platen from one type to another, such as discrete or cut paper to continuous paper.

2. Description of Prior Art

In conventional print paper feeding apparatus, switching from feed of one type of paper to another is usually accomplished by use of an electromagnetic clutch, which is complex in structure and operation. Disadvantageously, such prior art arrangements are relatively expensive, and deficient in durability.

SUMMARY OF THE INVENTION

Accordingly, an object of the invention is to overcome the aforementioned and other disadvantageous and deficiencies of the prior art.

Another object is to provide a print paper feeding apparatus which is simple in construction and which is capable of switching over between discrete or cut paper feeding operation and continuous paper feeding operation.

A further object is to provide a print paper feeding apparatus which is simple in construction, inexpensive and of superior durability.

The foregoing and other objects are attained by the invention which encompasses a print paper feeding apparatus comprising a paper feed motor; a platen adapted to be rotated by the paper feed motor; a plurality of rollers rotatably held in pressure contact with the platen; a pin tractor adapted to be driven by a driving gear which is rotated by the paper feed motor; a gear transmitting mechanism comprising a plurality of gears disposed between the paper feed motor and the platent; an actuating lever pivotally supporting at one end thereof an idle gear engaged with the pin tractor driving gear, the actuating lever being movably supported between an engaged position wherein the idle gear engages a gear of the gear transmitting mechanism and a disengaged position wherein the idle gear is disengaged from the gear of the gear transmitting mechanism; a switching lever having one end thereof connected to the other end of the actuating lever and supported switchably between the engaged position and the disengaged position, the switching lever having an operating portion formed at the other end thereof; and a biasing member for urging and holding the actuating lever to and in the engaged position and in the disengaged position.

BRIEF DESCRIPTION OF DRAWING

The sole FIGURE of the drawing is a side sectional view depicting an illustrative embodiment of the invention.

DETAILED DESCRIPTION OF PREFERRED EMBODIMENTS

Referring to the sole FIGURE, a paper feed motor 1 is fixed to a frame (not shown), and has a shaft 2, to which is fixed a driving gear 3. Above driving gear 3 is disposed a gear transmitting mechanism 7 comprising a first intermediate gear 4, a second intermediate gear 5

(which is fixed to the same shaft as gear 4) and a third intermediate gear 6, engaged with second intermediate gear 5. First intermediate gear 4 and driving gear 3 are intermeshed with each other at all times. Third intermediate gear 6 is engaged with platen driving gear 10 when fixedly mounted on one end of a platen shaft 9 of a platen 8, which is supported rotatably by the frame. The rotation of motor 1 is transmitted from gear 3 to platen driving gear 10 through mechanism 7, with forward and reverse rotations of motor 1, platen 8 is also rotated in corresponding directions. Rollers 11,12 and 13 are mounted rotatably on respective support shafts to be in pressure contact with the peripheral surface of platen 8. A discrete or cut sheet paper 14 is moved by cooperative action of platen 8 and rollers 11,12,13.

A pin tractor 15 is supported by the frame so as to be positioned below platen 8. Pin tractor 15 is constructed so that a belt with pins is rotated by tractor wheels (not shown) fixedly mounted on a tractor driving shaft 16 and a support shaft 17, thereby moving continuous paper 18. A tractor driving gear 19 is fixedly mounted on tractor driving shaft 16, on which is also mounted an actuating lever 20, which has three arms. The lever 20 may be pivotally moved between the position shown in solid line and the position shown in dotted line. An idle gear 21 is rotatably supported at one end portion of a first arm 20*a* of lever 20 and is disposed so that it engages both third intermediate gear 6 of gear transmitting mechanism 7 and tractor driving gear 19 when actuating lever 20 is in the solid line position, and is disengaged from intermediate gear 6 when lever 20 is in the dotted line position.

Moreover, in an end portion of a second arm 20*b* of lever 20 is formed an elongated aperture 22 having retaining recesses 22*a* and 22*b*. Actuating lever 20 also comprises a third arm 20*c* which turns microswitch 23 "ON" and "OFF". The switch 23 functions to detect whether the paper feeding state is for a continuous paper or for a discrete or cut sheet paper. Third arm 20*c* turns microswitch 23 "OFF" when lever 20 is in the solid line position, indicating that the paper feeding state is for continuous paper. On the other hand, third arm 20*c* turns microswitch 23 "ON" when actuating lever 20 is in the dotted line position, indicating that the paper feeding state is for a discrete or cut sheet paper.

A manually operable switching lever 24 is supported pivotally about a shaft 25 which is fixed to the frame. A connecting pin 26, which is fixed on one end of switching lever 24, is loosely fitted in elongated aperture 22 formed in the end portion of second arm 20*b* of lever 20. Switching lever 24 and actuating lever 20 are interconnected through the loose fitting of connecting pin 26 and elongated aperture 22, so that lever 20 is moved between the solid line position and the dotted line position, by operation of the operating arm portion 24*b* of switching lever 24. Switching lever 24 is adapted to be held in two positions:(1) the position shown by the solid line, and (2) the position shown by the dotted line, by the action of a positioning spring 27 which is mounted between an intermediate portion of the switching lever 24 and the frame. At this time, connecting pin 26 is fitted in either the retaining recess 22*a* or 22*b* of elongated aperture 22.

A plurality of sensors are provided to detect the position of the paper. For example, sensor 28 detects the top end of continuous paper 18, and sensor 29 detects the top end of discrete or cut paper 14. A printing head 30 is provided and adapted to be moved along the longitudinal direction of the platen 8 for printing of desired characters on the discrete or cut paper 14 or on the continuous paper 18, as the paper is fed on plate 8.

The illustrative embodiment is operated as follows. First, to feed continuous paper 18, switching lever 24 is switched, such as manually, to the solid line position, whereby connecting pin 26 is fitted in retaining recess 22*a* of elongated aperture 22, and actuating lever 20 is held in the solid line position by action of spring 27. At this time, idle gear 21 engages both third intermediate gear 6 of gear transmitting mechanism 7 and tractor driving gear 19, so that rotation of paper feed motor 1 can be transmitted to both platen 8 and pin tractor 15. In this condition, microswitch 23 is caused to be in an "OFF" position by action of arm 20*c*.

Then, continuous paper 18 is loaded on pin tractor 15 and paper feed motor 1 is driven in the direction of arrow A to move continuous paper 18 forward until sensor 28 detects the top end of paper 18. Upon detection of the top end of paper 18, by sensor 28, motor 1 causes paper 18 to move in the direction of arrow B by a predetermined amount in accordance with the detected signal, onto platen 8, thereby to expose the paper 18 to be contactable by print head 30. Thereafter, desired printing is effected by head 30 onto the continuous paper 18.

For switching the type of paper on platen 8 from the continuous paper 18 to discrete or cut paper 14, the printing portion of paper 18, loaded on platen 8, is cut off. Then, motor 1 is reverse rotated in the direction of arrow C until sensor 28 detect the top part of paper 18. At this time, continuous paper 18 remains loaded on pin tractor 15.

Switching lever 24 is switched from the solid line position to the dotted line position, such as by manual operation. Connecting pin 26 is fitted in retaining recess 22*b* of elongated aperture 22 and actuating lever 20 is held in dotted line position by action of spring 27. In this condition, idle gear 21 is disengaged from third intermediate gear 6 of gear transmitting mechanism 7, so that rotation of motor 1 is transmitted to only platen 8 and not to pin tractor 15. Microswitch 23 is caused by arm 20*c* to be in an "ON" state. Subsequently, discrete paper 14 is inserted between platen 8 and roller 11 and motor 1 is driven in the direction of arrow A until sensor 29 detects the top end of discrete paper 14, Then, motor 1 causes paper 14 to move forward by a predetermined amount in accordance with the detected signal, thereby to load paper 14 onto platen 8. The paper 14 is then in position for printing by the print head 30. Thereafter, desired printing of characters is performed by head 30 onto paper 14.

According to the illustrative embodiment, advantageously, the print paper feeding apparatus is constructed so that the selection of positions can be effected by simple manual switching operation of the switching lever 24, between (1) an engaged position wherein idle gear 21, pivotally supported by actuating lever 20, engages both third intermediate gear 6 and tractor driving gear 19 and (2) a disengaged position wherein the engagement of idle gear 21 with both gears 6 and 19 is released. Consequently, with a single motor 1, as a drive source, it is possible to select in a simple manner, a condition wherein both platen 8 and pin tractor 15 are driven, and a condition wherein only platen 8 is driven. Thus, the switching between paper feeding operation for continuous paper 18 and discrete paper 14 can be effected by the simple arrangement of the invention without requirement of complicated electromagnetic clutches, or the like.

Moreover, advantageously, discrete paper 14 can be loaded onto platen 8 for printing, at the same time that continuous paper 18 is retained in a loaded state on pin tractor 15. Accordingly, it is not necessary to remove the continuous paper 18 from tractor 15 each time the paper on platen 8 is changed from continuous to discrete. Consequently, switching of paper types is done smoothly and efficiently with this invention.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. A print paper feeding apparatus for use in a printing machine, comprising a paper feed motor;

a platen adapted to be loaded with a discrete print paper or a continuous print paper and rotated by said motor;

rollers held in pressure contact with said platen;

a driving gear fixedly mounted on a driving shaft;

a pin tractor having said driving shaft and adapted to be driven by said driving gear, said driving gear being rotated by said motor;

said platen and said rollers acting cooperatively to feed said discrete paper onto said platen, and said platen and said pin tractor acting cooperatively to feed said continuous paper onto said platen;

a gear transmitting mechanism comprising a plurality of gears disposed between said motor and said platen;

an idle gear;

an actuating lever pivotally supporting said idle gear at an end thereof engaged with said driving gear, said actuating lever being movable supported on said driving shaft between an engaged position wherein said idle gear engages a gear of said gear transmitting mechanism and a disengaged position wherein said engaging of said idle gear and said gear of said gear transmitting mechanism is released;

a switching lever having one end connected to another end of said actuating lever and supported switchably between said engaged and disengaged positions, said switching lever having an operating position formed at another end thereof; and a biasing member for urging and holding said actuating lever to and in said engaged and disengaged positions.

2. The apparatus of claim 1, wherein a connecting pin is fixed to one end of said switching lever, and said actuating lever has an elongated aperture formed in said other end thereof, with said connecting pin being loosely fitted in said elongated aperture.

3. The apparatus of claim 2, wherein said elongated aperature is formed with recesses in both ends thereof, said recesses being capable of engaging said connecting pin and defining a position of engagement of said elongated aperture with said connecting pin.

4. The apparatus of claim 1, further comprising a detector means for detecting said engaged or disengaged position of said actuating lever.

5. The apparatus of claim 4, wnerein said actuating lever has an arm portion for actuating said detector means.

6. The apparatus of claim 1, wherein said idle gear is engaged with said driving gear at all times.

* * * * *